US007292805B2

(12) United States Patent
Hashimoto et al.

(10) Patent No.: US 7,292,805 B2
(45) Date of Patent: Nov. 6, 2007

(54) IMAGE FORMING APPARATUS HAVING A SHEET REMOVAL PORTION

(75) Inventors: Haruo Hashimoto, Ibaraki (JP); Kazuhiro Wakamatsu, Ibaraki (JP); Tadashi Okano, Ibaraki (JP); Takamitsu Ikematsu, Ibaraki (JP); Shoji Ukei, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 218 days.

(21) Appl. No.: 11/017,855

(22) Filed: Dec. 22, 2004

(65) Prior Publication Data

US 2005/0163533 A1 Jul. 28, 2005

(30) Foreign Application Priority Data

Dec. 24, 2003 (JP) ..... P2003-427586
Nov. 5, 2004 (JP) ..... P2004-321850

(51) Int. Cl.
*G03G 21/00* (2006.01)

(52) U.S. Cl. ..... 399/124

(58) Field of Classification Search ..... 399/124, 399/302, 308, 388, 397, 405
See application file for complete search history.

(56) References Cited

U.S. PATENT DOCUMENTS

| | | | | |
|---|---|---|---|---|
| 5,887,228 | A * | 3/1999 | Motohashi et al. | 399/111 |
| 6,215,970 | B1 * | 4/2001 | Yoshikawa et al. | 399/124 |
| 6,775,515 | B2 * | 8/2004 | Ouchi | 399/393 |
| 6,799,011 | B2 * | 9/2004 | Abe et al. | 399/299 |
| 7,020,415 | B2 * | 3/2006 | Abe | 399/110 |
| 7,031,640 | B2 * | 4/2006 | Komoda et al. | 399/124 |
| 2003/0235430 | A1 * | 12/2003 | Koshida | 399/124 |

FOREIGN PATENT DOCUMENTS

| | | |
|---|---|---|
| JP | 2003-186371 | 7/2003 |
| JP | 2003186371 A * | 7/2003 |

* cited by examiner

*Primary Examiner*—Robert Beatty
(74) *Attorney, Agent, or Firm*—McGinn IP Law Group, PLLC

(57) ABSTRACT

An image forming device includes an openable panel disposed on a side of the image forming device. The panel includes a pair of carrying rollers, a transcribing roller and a pair of discharging sheet carrying rollers.

18 Claims, 6 Drawing Sheets

IMAGE FORMING APPARATUS HAVING A SHEET REMOVAL PORTION

BACKGROUND OF THE INVENTION

1. Field of the Invention

The present invention relates to an image forming apparatus. Particularly, it more specifically relates to an improvement in an image forming apparatus including an opening and closing portion that remove the sheet remaining in the apparatus.

2. Description of the Related Art

In an image forming apparatus, it is general to include an opening and closing portion of a door, a cover or the like to be able to simply remove the sheet remaining in the apparatus by a failure in carrying the sheet or the like by a user. For example, according to JP-A-2003-186371, there is described a configuration of an opening and closing portion in which a driven roller constituting a pair of registration rollers, a transfer belt device and an upper roller constituting a pair of sheet discharging rollers are provided to an exterior cover, and when the exterior cover is opened, a sheet carrying path from a sheet feeding portion to a sheet discharging portion is exposed. As a result, there poses a problem that away of use of the apparatus is poor for the user and running cost is increased.

SUMMARY OF THE INVENTION

However, in the case of JP-A-2003-186371, the exterior cover provided to be openably and closably is mounted with the transfer belt device configured by a belt, a plurality of rollers for supporting the belt and a transcribing roller or the like and therefore, a configuration at a surrounding of a transcribing device becomes complicated and the configuration is hardly regarded as pertinent in view of providing an inexpensive image forming apparatus.

Further, in the case of JP-A-2003-186371, there is constructed a configuration in which by moving the driven roller constituting the pair of registration rollers and the upper roller constituting the pair of sheet discharging rollers along with the exterior cover, contact of the respective pairs of rollers is released. Therefore, there is a case of bringing the pairs of rollers into contact with each other in a state of being shifted from each other delicately depending on a way of closing the exterior cover and there is a drawback that a stable sheet carrying function is difficult to achieve. Further, also dimensional accuracies between the respective rollers are difficult to be achieved by being involved with attaching and detaching operation accompanied by opening and closing the exterior cover.

It is an object of the invention to provide an image forming apparatus including a sheet feeding cassette for containing a sheet, sheet feeding device for feeding the sheet from the sheet feeding cassette, a transcribing roller for transcribing a toner image formed at an image carrier onto the sheet, fixing device for fixing the toner image transcribed onto the sheet to the sheet, a sheet discharging tray for receiving the sheet fed from the fixing device, a pair of carrying device provided between the sheet feeding device and the transcribing device for carrying the sheet fed from the sheet feeding device toward the transcribing device, and a pair of discharge sheet carrying device provided between the fixing device and the sheet discharging tray for carrying the sheet fed from the fixing device toward the sheet discharging tray, wherein the carrying device, the transcribing roller and the discharge sheet carrying device are held by a single opening and closing member provided openably and closably to a main body of the image forming apparatus.

According to one aspect of the invention, a configuration of a transcribing device mounted to the opening and closing member can be simplified. Further, there can be provided the image forming apparatus easy to access to sheet remaining in the apparatus and excellent in a way of use while maintaining a stable sheet carrying function.

DESCRIPTION OF THE PREFERRED EMBODIMENTS

An explanation will be given of embodiments of the invention in reference to the drawings as follows.

Figure 1:
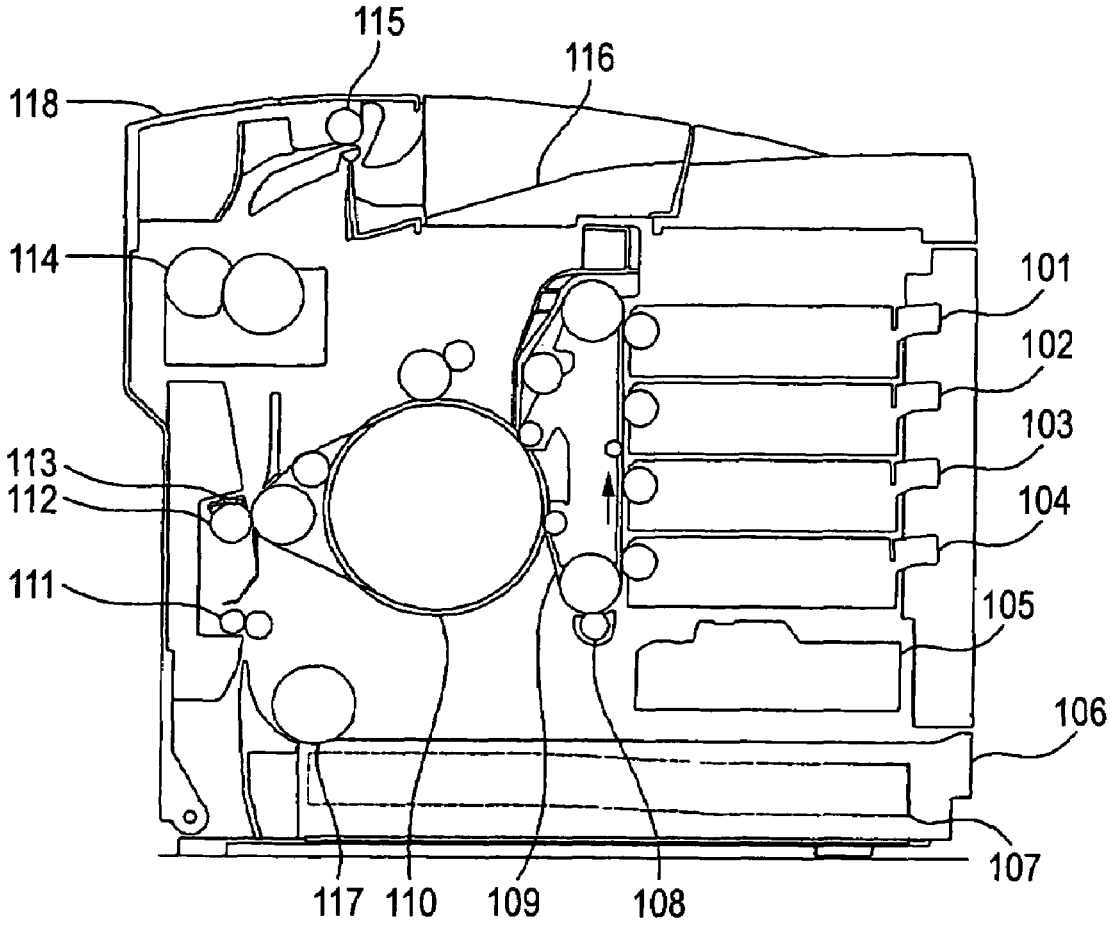
FIG. 1 is a total configuration view of an image forming apparatus according to first embodiment of the invention.

First, an explanation will be given of a total configuration of an image forming apparatus in reference to FIG. 1. In FIG. 1, numeral 109 designates a photosensitive belt which is supported to be able to move endlessly in an arrow direction. Numeral 108 designates a charger and the charger 108 uniformly charges a surface of the photosensitive belt 109 by a printing start signal from a host. An optical unit 105 for irradiating light to the surface of the charged photosensitive belt 109 exposes the photosensitive belt 109 in accordance with printing data from the host to form an electrostatic latent image on the surface of the photosensitive belt 109.

The electrostatic latent image formed on the photosensitive belt 109 is supplied with a toner of any color of developing unit 101, 102, 103, 104 to be visualized as a toner image and is carried to a region at which the photosensitive belt 109 and an intermediate transcribing member 110 are brought into contact with each other (hereinafter, referred to as "primary transcribing position"). At the primary transcribing position, the toner image on the photosensitive belt 109 is transcribed onto a surface of the intermediate transcribing member 110 by a potential difference between the photosensitive belt 109 and the intermediate transcribing member 110.

A surface of the photosensitive belt 109 which has passed the primary transcribing position is cleaned via an discharger (not illustrated) and a cleaning unit (not illustrated) to be brought into a state of capable of forming a successive image.

By repeating the above-described step by the respective developing unit 101, 102, 103, 104 in accordance with single color printing and plural colors printing by a necessary number of times the toner image is formed on the intermediate transcribing member 110.

The toner image transcribed onto the intermediate transcribing member 110 is transcribed onto sheet at a region at which the intermediate transcribing member 110 and a transcribing roller 112 are brought into contact with each other (hereinafter, referred to as "secondary transcribing position"). Sheet transcribed with the toner image is separated from the intermediate transcribing member 110 by being operated by an discharger 113, and is fed to a fixing unit 114. The fixing unit can be applied with a well-known fixing system of atype of nipping and carrying sheet by a heat roller and a press roller (or heat roller), a type of nipping and carrying sheet by a heat roller and a press belt (or press belt including a heat source) or the like, sheet fixed with the toner image is discharged to a sheet discharging tray 116 provided at an upper portion of a main body of the image forming apparatus.

A pair of carrying rollers 111 are provided between a sheet feeding roller 117 and the transcribing roller 112. Although the carrying roller 111 may be a carrying roller only for carrying a sheet 107 fed out from a sheet feeding cassette 106 to the secondary transcribing position, according to the embodiment, the carrying roller 111 is provided as a registration roller for correcting a skew of sheet.

The registration roller 117 corrects an attitude of sheet fed out from the sheet feeding cassette 106 by the sheet feeding roller 117 to bring sheet at standby and to feed out sheet toward the transcribing roller 112 in synchronism with a timing of transcribing the toner image formed at the intermediate transcribing member 110 to a predetermined position of sheet.

Further, a pair of sheet discharging rollers 115 as discharge sheet carrying device are provided between the fixing unit 114 and the sheet discharging tray 116.

Figure 2:
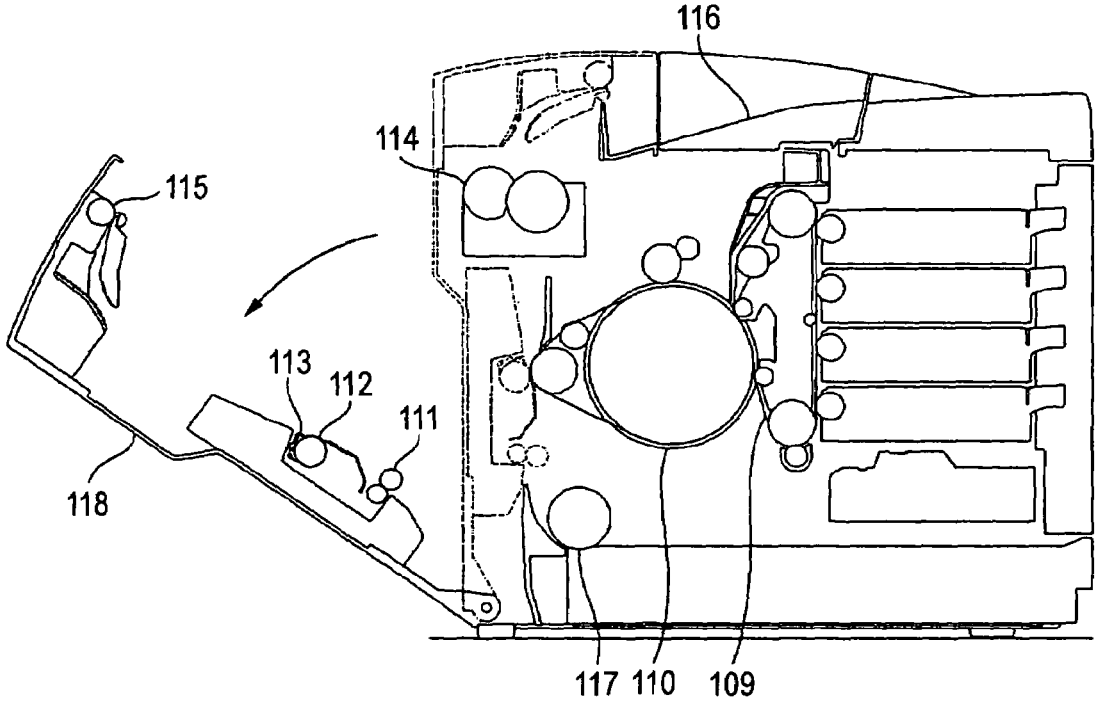
FIG. 2 is a total configuration view showing a state of opening and closing an opening and closing member in the image forming apparatus according to first embodiment of the invention.

A frame 118 made of a metal constituting a side face of the main body of the image forming apparatus is supported by the main body of the image forming apparatus openably and closably as shown by FIG. 2 and the frame 118 is attached with the pair of registration rollers 111, the transcribing roller 112, the discharger 113 and the pair of sheet discharging rollers 115.

Figure 3:
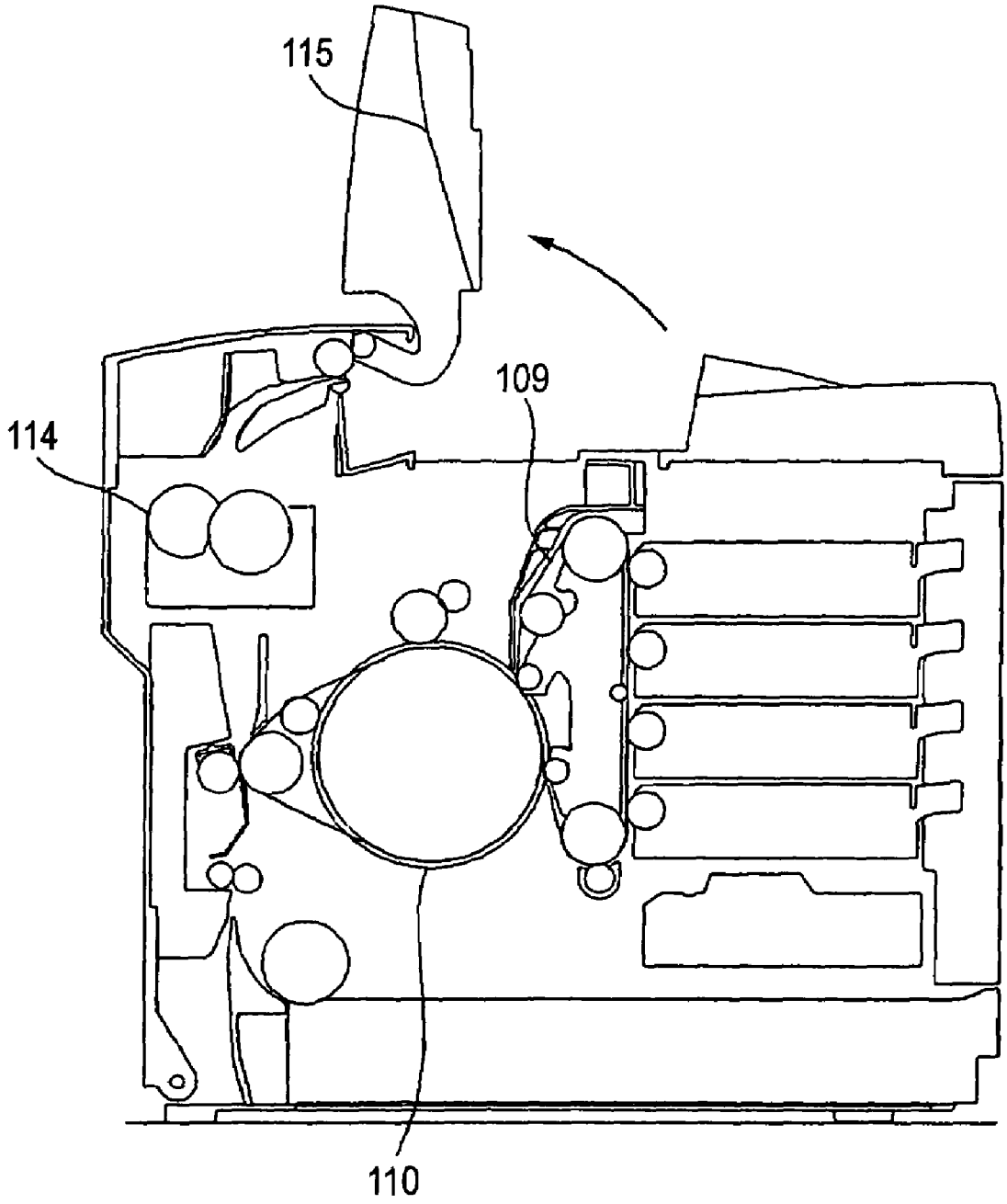
FIG. 3 is a total configuration view showing a state of opening a sheet discharging tray in the image forming apparatus according to first embodiment of the invention.

Further, the sheet discharging tray 116 provided at the upper portion of the main body of the image forming apparatus is arranged above the photosensitive belt 109, and is openably and closably supported by the main body of the image forming apparatus as shown by FIG. 3.

In the above-described configuration, when sheet remaining in the apparatus is removed, as shown by FIG. 2, the frame 118 is opened. At this occasion, a sheet carrying path from a vicinity of the sheet feeding roller 117 to the sheet discharging tray 116 is exposed and therefore, a position of sheet can be confirmed immediately and remaining sheet can be removed easily.

In this case, the invention is constructed by a configuration in which when the frame 118 is opened, the registration rollers 111 and the sheet discharging rollers 115 are removed from the main body of the image forming apparatus in a state of constituting pairs. Although there is a case in which sheet is jammed while being nipped by the registration rollers 111 or the sheet discharging rollers 115, nipping forces of the register rollers 111 and the sheet discharging rollers 115 are set to be smaller than that of the fixing unit 114 and therefore, even when sheet is stopped in the state that sheet is nipped by the registration rollers 111 and the sheet discharging rollers 115, when the frame 118 is opened, a sheet is slidingly drawn out from the registration rollers 111 and the sheet discharging rollers 115 while being restricted by the fixing unit 114 and therefore, sheet hardly remains at the registration rollers 111 and the sheet discharging rollers 115.

Further, when the frame 118 is opened, the photosensitive belt 109 is not exposed and therefore, service life of the photosensitive belt can be prevented from being shortened by outside light or the like. Further, also access can be made to the intermediate transcribing member 110 easily by opening the frame 118 similar to the case of removing remaining sheet.

The photosensitive belt 109 can be interchanged by opening the discharging tray 116 as shown by FIG. 3 and drawing out the photosensitive belt 109 to an upper side. Therefore, it is not necessary to open the frame 118 and the photosensitive belt 109 can be dealt with only by opening and closing the sheet discharging tray 116 and interchanging operation can safely be carried out without exposing a heated member at high temperature of the fixing unit or the like.

Next, an explanation will be given of second embodiment of the invention in reference to FIG. 4, FIG. 5 and FIG. 6. The embodiment differs from the preceding embodiment in including reverse sheet feeding unit for reversing front and back of sheet for duplex printing.

Figure 4:
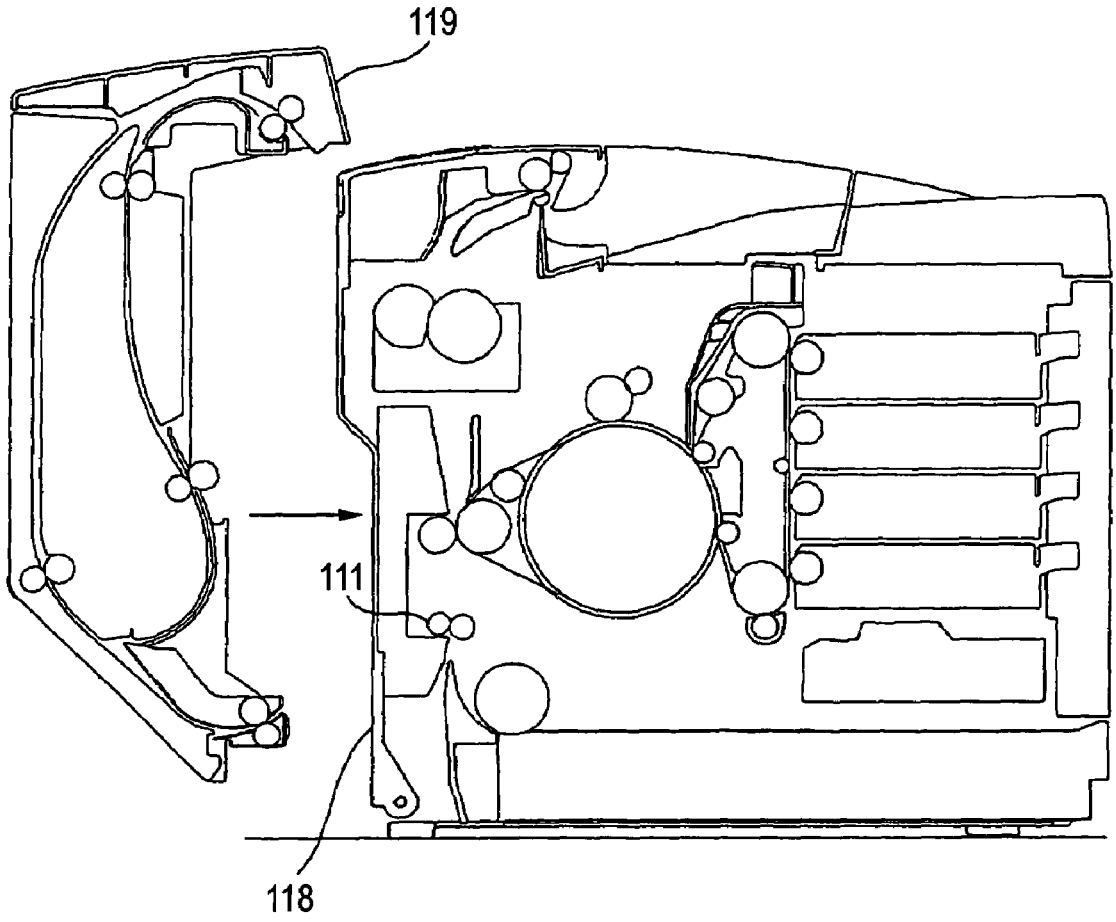
FIG. 4 is a total configuration view of an image forming apparatus showing second embodiment of the invention.
Figure 5:
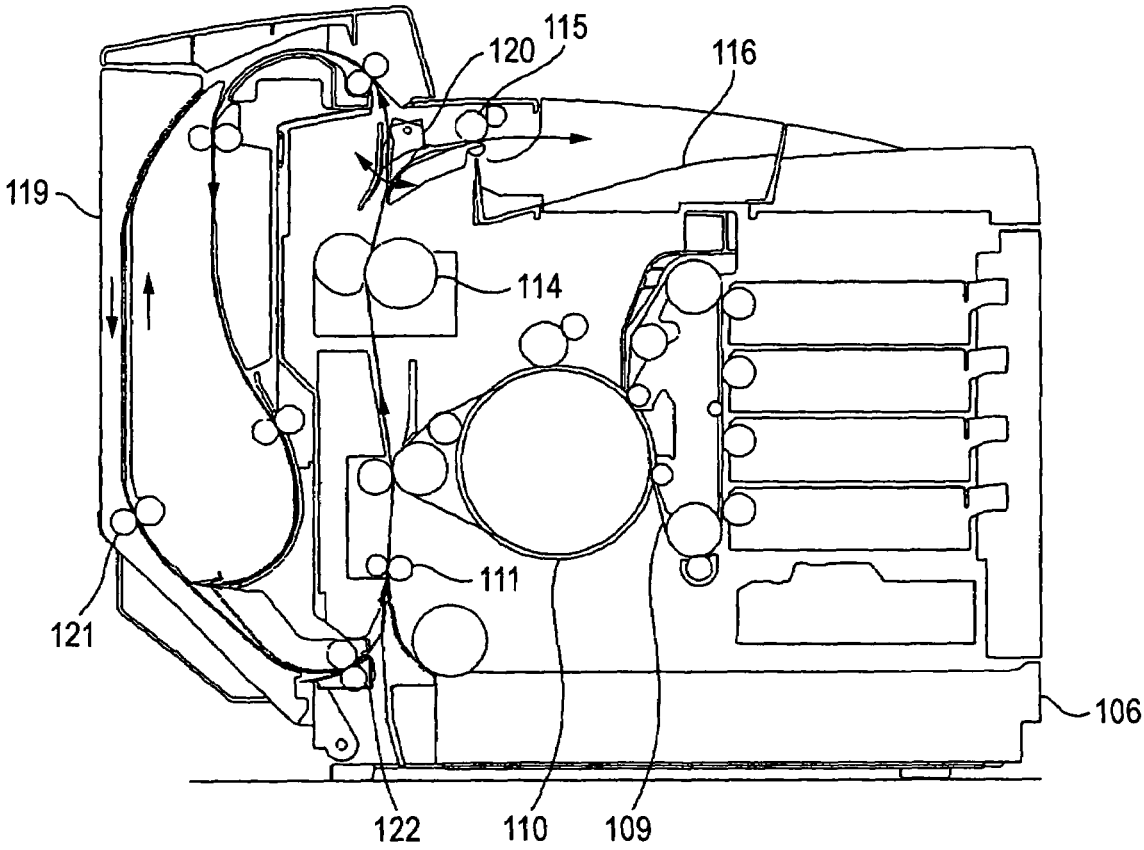
FIG. 5 is a total configuration view for explaining operation of both faces printing according to second embodiment of the invention.

A reverse sheet feeding unit 119 is attached to the frame 118 by well-known unit of a screw or the like from an arrow direction of FIG. 4. The sheet reversed by the reverse sheet feeding unit 119 is carried upstream of the registration rollers 111, and the sheet is carried to the secondary transcribing portion by the registration rollers 11.

By the above-described configuration, the reverse sheet feeding apparatus 119 can be opened and closed with the frame 118.

In the duplex mode, a first face of sheet is printed based on the preceding embodiment and the sheet is fed out from the fixing unit 114. The sheet fed out from the fixing unit 114 is guided to the reverse sheet feeding unit 119 by a switching guide 120 and sheet is reversed by a reversing roller 121. Successively, sheet is carried from the reverse sheet feeding unit 119 to the registration rollers 111 by a carrying roller 122 and a second face of sheet is transcribed and fixed with a toner image. The sheet fed out from the fixing unit 114 is fed to the sheet discharging roller 115 by the switching guide 120 and is discharged to outside of the unit (sheet discharging tray).

Figure 6:
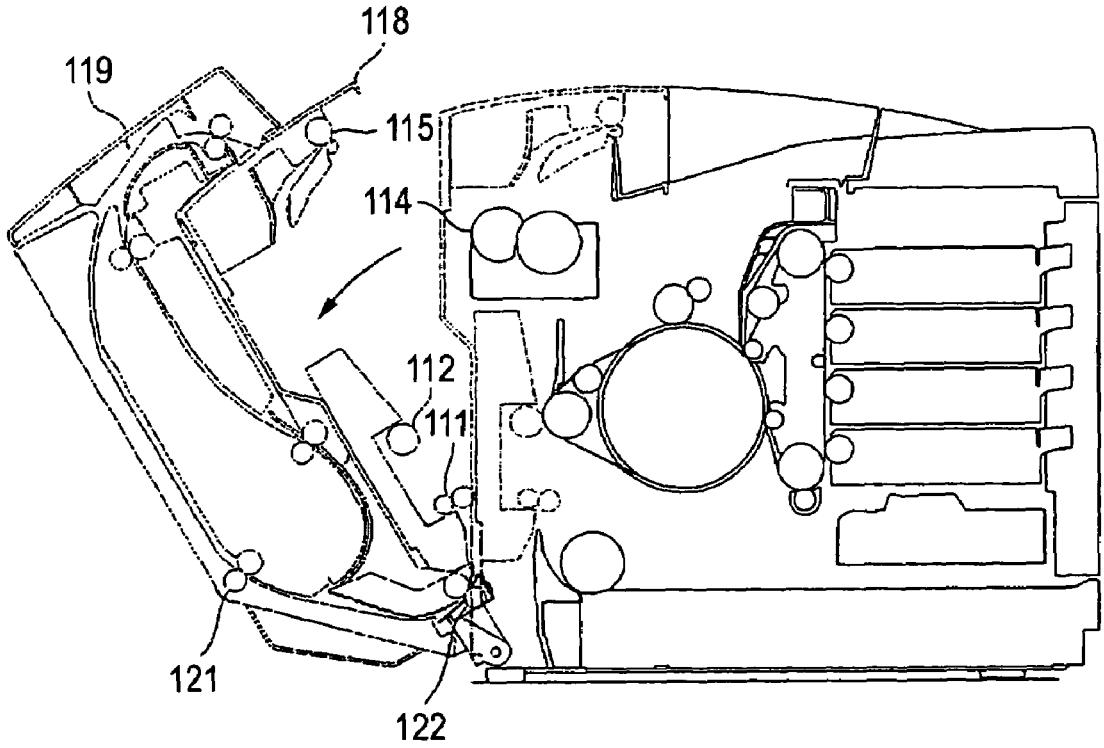
FIG. 6 is a total configuration view showing a state of opening an opening and closing member according to second embodiment of the invention.

FIG. 6 shows a state of opening the reverse sheet feeding unit 119 with the frame 118.

Even when the frame 118 is mounted with the reverse sheet feeding unit 119, the frame 118 can be opened and closed with the reverse sheet feeding unit 119, the sheet carrying path from a vicinity of the sheet feeding roller to the sheet discharging tray is exposed and therefore, the position of sheet can be confirmed immediately and remaining sheet can be removed easily.

Further, even in the case in which a failure in carrying sheet is brought about when sheet is guided from the reverse sheet feeding unit 119 to the registration rollers 111 in duplex printing mode, a lead edge portion of sheet is exposed by opening the frame 118 and therefore, remaining sheet can be removed easily by drawing out the lead edge portion of sheet.

What is claimed is:

1. An image forming apparatus comprising:

a sheet feeding cassette for accommodating a sheet;

a sheet feeding means for feeding the sheet from the sheet feeding cassette;

a transcribing roller for transcribing a toner image formed at an image carrier onto the sheet;

a fixing means for fixing the toner image transcribed onto the sheet to the sheet;

a sheet discharging tray for receiving the sheet fed from the fixing means;

a pair of carrying means, disposed between the sheet feeding means and the transcribing roller, for carrying the sheet fed from the sheet feeding means toward the transcribing roller; and a pair of discharge sheet carrying means, disposed between the fixing means and the sheet discharging tray, for carrying the sheet fed from the fixing means toward the sheet discharging tray, wherein the carrying means, the transcribing roller and the discharge sheet carrying means are held by a single opening and closing member capable of opening and closing to a main body of the image forming apparatus, and the single opening and closing member exposes the image carrier and the fixing means, fixed within the main body, when the opening and closing member is opened. wherein the carrying means and the discharge sheet carrying means are held by the opening and closing member in a state that the carrying means and the discharge sheet carrying means are in pair forms.

2. The image forming apparatus according to claim 1, wherein the carrying means comprises a pair of rollers in contact with each other.

3. The image forming apparatus according to claim 2, wherein the pair of rollers comprises a pair of registration rollers that correct a skew of sheet.

4. The image forming apparatus according to claim 1, wherein the discharge sheet carrying means comprises a pair of rollers in contact with each other.

5. The image forming apparatus according to claim 1, wherein the image carrier comprises an intermediate transcribing member.

6. The image forming apparatus according to claim 1, wherein the sheet discharging tray is provided openably and closably to the main body of the image forming apparatus so as to expose the image carrier when the sheet discharging tray is opened.

7. The image forming apparatus according to claim 6, wherein the image carrier comprises a photosensitive member.

8. The image forming apparatus according to claim 1, wherein the single opening and closing member includes a reverse sheet feeding means for reversing the sheet fed from the fixing means and feeds again the sheet to the carrying means.

9. The image forming apparatus according to claim 1, further comprising a discharger held on the single opening and closing member.

10. The image forming apparatus according to claim 1, wherein a sheet carrying path formed between the sheet feeding means and the fixing means within the image forming device is exposed when the single opening and closing member is in an open position.

11. The image forming apparatus according to claim 1, further comprising a photosensitive belt disposed around the image carrier, wherein the single opening and closing member is capable of opening without exposing the photosensitive belt.

12. The image forming apparatus according to claim 8, wherein the reverse sheet feeding means comprises a duplex printing means and the fixing means is held by the main body of the image forming apparatus.

13. An image forming apparatus, comprising:

a sheet feeding cassette for accommodating a sheet;

a sheet feeding means for feeding the sheet from the sheet feeding cassette;

a transcribing roller for transcribing a toner image formed at an image carrier onto the sheet;

a fixing means for fixing the toner image transcribed onto the sheet to the sheet;

a sheet discharging tray for receiving the sheet fed from the fixing means;

a pair of carrying means, disposed between the sheet feeding means and the transcribing roller, for carrying the sheet fed from the sheet feeding means toward the transcribing roller; and a pair of dischargc sheet carrying means, disposed between the fixing means and the sheet discharging tray, for carrying the sheet fed from the fixing means toward the sheet discharging tray, wherein the pair of carrying means, the transcribing roller and the pair of discharge sheet carrying means are held by a single opening and closing member capable of opening and closing to a main body of the image forming apparatus, and the single opening and closing member includes a reverse sheet feeding means for reversing the sheet fed from the fixing means and feeds again the sheet to the carrying means.

14. An image forming apparatus, comprising:

a housing having an openable panel disposed on one side of the housing;

a transcribing roller that transcribes a toner image formed at an intermediate transcribing member onto a printable medium;

a pair of carrying rollers that carry the printable medium toward the transcribing roller; and a pair of sheet discharge rollers that carry the printable medium toward the sheet discharging tray, wherein:

the transcribing roller, the pair of carrying rollers, and the pair of sheet discharge rollers are disposed on the openable panel, and the openable panel exposes the intermediate transcribing member and a fixing device fixed within the housing when the openable panel is in an open position.

15. The image forming apparatus according to claim 14, further comprising a photosensitive belt disposed around the intermediate transcribing member, wherein the openable panel is capable of opening without exposing the photosensitive belt.

16. The image forming apparatus according to claim 14, further comprising a reverse sheet feeding unit, wherein the reverse sheet feeding unit is disposed on the openable panel.

17. The image forming apparatus according to claim 14, further comprising a discharge tray fixed to the housing.

18. The image forming apparatus according to claim 14, further comprising a discharging device held on the openable panel.

* * * * *